US009435065B2

(12) United States Patent
Favaro et al.

(10) Patent No.: US 9,435,065 B2
(45) Date of Patent: Sep. 6, 2016

(54) HOUSEHOLD APPLIANCE FOR WALL MOUNTING

(71) Applicant: Electrolux Home Products Corporation N.V., Brussels (BE)

(72) Inventors: Daniele Favaro, Pramaggiore (IT); Maurizio Del Pos, Pordenone (IT)

(73) Assignee: Electrolux Home Products Corporation N.V., Brussels (BE)

( * ) Notice: Subject to any disclaimer, the term of this patent is extended or adjusted under 35 U.S.C. 154(b) by 0 days.

(21) Appl. No.: 14/357,672

(22) PCT Filed: Nov. 15, 2012

(86) PCT No.: PCT/EP2012/072776

§ 371 (c)(1),
(2) Date: May 12, 2014

(87) PCT Pub. No.: WO2013/072432

PCT Pub. Date: May 23, 2013

(65) Prior Publication Data

US 2014/0345333 A1 Nov. 27, 2014

(30) Foreign Application Priority Data

Nov. 17, 2011 (EP) ..... 11189476

(51) Int. Cl.

| | |
|---|---|
| ***D06F 39/12*** | (2006.01) |
| ***D06F 39/00*** | (2006.01) |
| *D06F 23/02* | (2006.01) |
| *D06F 37/22* | (2006.01) |

(52) U.S. Cl.

CPC ..... *D06F 39/001* (2013.01); *D06F 39/12* (2013.01); *D06F 39/125* (2013.01); *D06F 23/02* (2013.01); *D06F 37/22* (2013.01)

(58) Field of Classification Search
None
See application file for complete search history.

(56) References Cited

U.S. PATENT DOCUMENTS

| | | | | |
|---|---|---|---|---|
| 3,471,940 | A | 10/1969 | Smith | |
| 4,868,998 | A | 9/1989 | Rubin | |
| 5,568,691 | A | 10/1996 | Rubin | |
| 2007/0137260 | A1 * | 6/2007 | Shikamori | D06F 17/06 68/3 R |
| 2008/0264112 | A1 * | 10/2008 | Son | D06F 37/26 68/24 |

(Continued)

FOREIGN PATENT DOCUMENTS

| | | |
|---|---|---|
| EP | 2317001 | 5/2011 |
| EP | 2317001 A1 * | 5/2011 |
| EP | 2317002 | 5/2011 |

OTHER PUBLICATIONS

International Search Report mailed Dec. 14, 2012 in corresponding International Application No. PCT/EP2012/072776.

(Continued)

*Primary Examiner* — Michael Barr
*Assistant Examiner* — Cristi Tate-Sims
(74) *Attorney, Agent, or Firm* — Banner & Witcoff, Ltd.

(57) ABSTRACT

A wall-mount household appliance (100) includes a washing assembly with a washing tub (200) rotatably housing a rotatable drum (201). The household appliance is configured to be mounted to a wall (105), characterized by including a wall-mounting frame (215; 215') configured to be fixed to the wall, and elastic coupling elements (235, 240) elastically coupling the washing tub (200) to the wall-mounting frame (215; 215'). The said elastic coupling elements (235, 240) are connected at a respective one end thereof to a cylindrical lateral wall of the washing tub (200).

16 Claims, 12 Drawing Sheets

(56) References Cited

U.S. PATENT DOCUMENTS

2009/0151084 A1* 6/2009 Lee ..... D06F 35/006 8/149.1
2009/0288260 A1* 11/2009 Jurmann ..... D06F 37/203 8/159
2011/0162442 A1* 7/2011 Ronlan et al. ..... 73/66

OTHER PUBLICATIONS

Extended European Search Report dated Apr. 20, 2012 in corresponding European Application No. 11189476.2.

* cited by examiner

HOUSEHOLD APPLIANCE FOR WALL MOUNTING

BACKGROUND OF THE INVENTION

1. Field of the Invention

The present invention generally relates to the field of household appliances, and in particular to laundry washing and washing/drying appliances like laundry washers and washers/dryers. Specifically, the present invention relates to a household appliance designed for wall mounting.

2. Overview of the Related Art

Household appliances designed for wall mounting are known in the art. This kind of installation is useful in those situations where space is so limited that there is no room for accommodating a floor-standing appliance (either of standard size or of small size, designed with a reduced load capacity, e.g., 1.5-2 kg of cotton load, for example targeted to people living as singles), or for installation in hotel rooms, or aboard ships.

For example, U.S. Pat. No. 4,868,998 discloses a wall-mounted tumble dryer. Other examples of wall-mounted garment dryer are provided in U.S. Pat. No. 5,568,691.

Conventionally, the household appliance is mounted to the wall by means of brackets, attached to the rear side of the appliance external cabinet, and that engage counter-brackets attached to the wall by means of screw anchors.

The Applicant has observed that, in general, a problem encountered in mounting to a wall household appliances having a rotating drum for loading items to be treated, like laundry washers and washers/dryers, is represented by the vibrations that inevitably are generated when the drum rotates, for washing or drying the items under treatment; the problem is especially felt in laundry washers and washers/dryers, because in the spinning phase of the washing cycle the rotational speed of the drum needs to be relatively high for efficiently removing water from the wet items. Such vibrations, that in floor-standing appliances are transmitted to the cabinet and then to the floor, in a wall-mounted appliance are instead transmitted to the wall, producing undesired noise at least for the neighbours, and, in time, they may even compromise the fixation of the appliance to the wall, and possibly damage the wall structure itself. In order to keep vibrations low, the load capacity of the appliance or/and the rotational speed of the drum should be kept low, but this undesirably limits the performance of the appliances and their marketability.

SUMMARY OF SELECTED INVENTIVE ASPECTS

In view of the state of the art outlined above, the Applicant tackled the problem of devising a household appliance intended for wall mounting, which has a wall-mounting arrangement adapted to reduce the vibrations and to ensure a homogeneous transfer of forces to the wall, so that the drum rotational speed needs not to be limited, and which at the same time is of simple construction, easy to assemble, and thus has a reduced cost.

According to an aspect of the present invention, there is provided a household appliance adapted to be mounted to a wall, comprising a washing assembly with a washing tub rotatably housing a rotatable drum.

The household appliance comprises a wall-mounting frame configured to be fixed to the wall. Elastic coupling elements are provided, elastically coupling the washing tub to the wall-mounting frame. The elastic coupling elements are connected at a respective one end thereof to a cylindrical lateral wall of the washing tub.

The wall-mounting frame may comprise a central frame portion and a plurality of frame arms projecting from the frame portion. The elastic coupling elements may each be connected at a respective another end thereof to a respective one of said projecting frame arms.

The elastic coupling elements may comprise springs and dampers.

For example, the elastic coupling elements may comprise at least two dampers and said plurality of frame arms may comprise at least two lower arms to each of which said another end of a respective one of said two dampers is connected.

Preferably, said elastic coupling elements may also comprise at least one spring and said plurality of frame arms may further comprise at least one upper arm to which said another end of the at least one spring is connected.

Even more preferably, said at least one spring may comprise two springs and said at least one upper arm may comprise two upper arms to each which said another end of a respective one of the two springs is connected.

The wall-mounting frame may be designed to be affixed to the wall by means of screws and/or anchor screws and/or one or more brackets affixed to the wall.

The wall-mounting frame may be designed to be affixed to the wall through at least one of the central frame portion and the plurality of frame arms.

The household appliance may also comprise a casing accommodating the washing assembly.

The casing may be fixable to the wall-mounting frame, for example by means of screws.

The casing may be elastically coupled to the washing assembly, for example by means of a bellow.

The household appliance may also comprise a front panel coupled to the washing assembly.

The wall-mount household appliance may be a laundry washer or a laundry washer/dryer.

BRIEF DESCRIPTION OF THE DRAWINGS

These and other features and advantages of the present invention will be made clear by the following detailed description of some embodiments thereof, provided merely by way of non-limitative examples. The description should be read in conjunction with the attached drawings, wherein.

DETAILED DESCRIPTION OF EXEMPLARY EMBODIMENTS OF THE INVENTION

Hereinafter, some embodiments according to the present invention of a household appliance designed for wall mounting will be presented and described. Even if in the following of this description the assumption will be made that the household appliance is a laundry washer, this is not to be construed as a limitation of the present invention, which applies straightforwardly to other types of appliances, like laundry washer/dryers, and in general the advantages of the present invention are achievable in any household appliance having a rotating drum for accommodating the items to be treated, particularly where the drum rotation speed may be relatively high.

Figure 1:
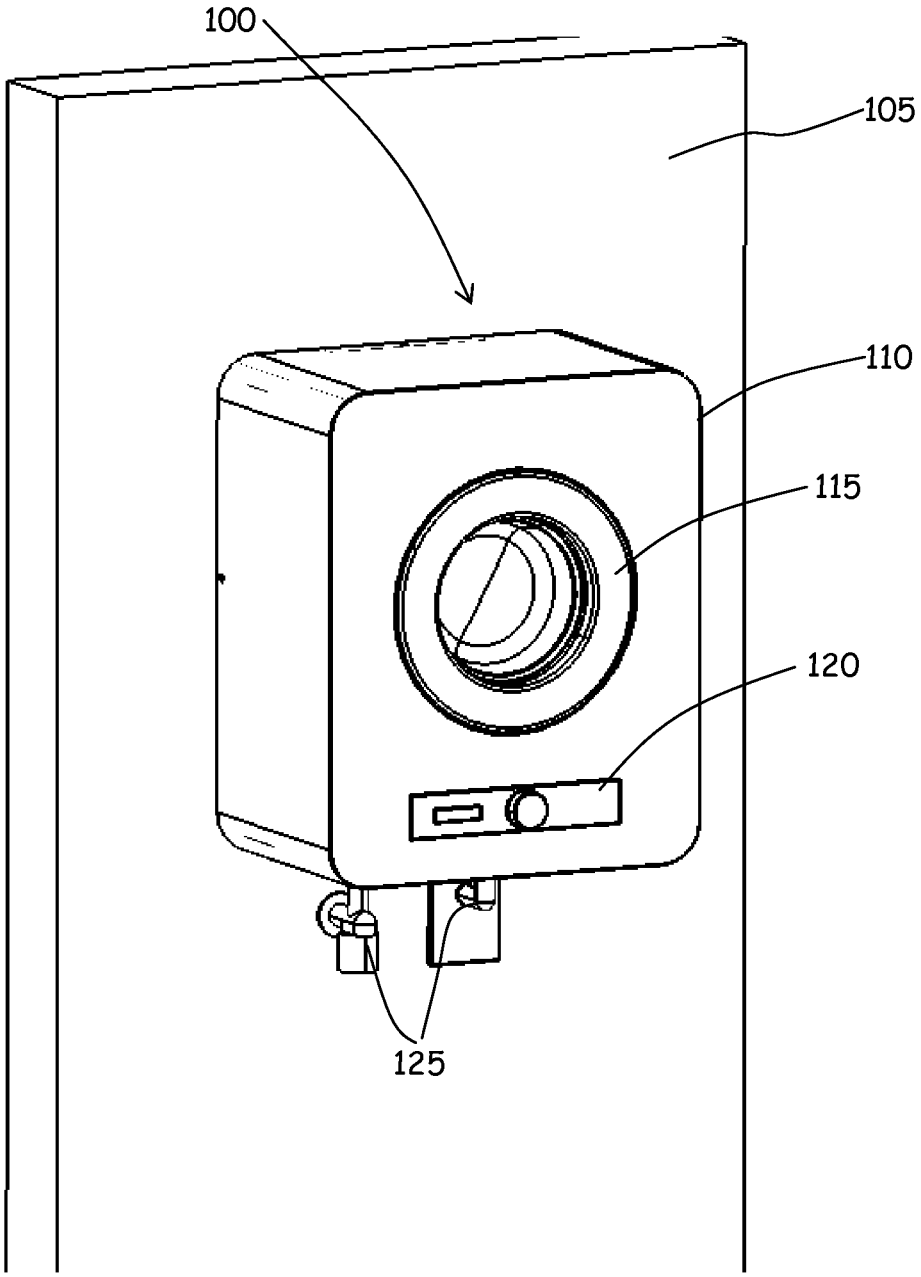
FIG. 1 shows a wall-mounted household appliance according to an embodiment of the present invention.
Figure 2:
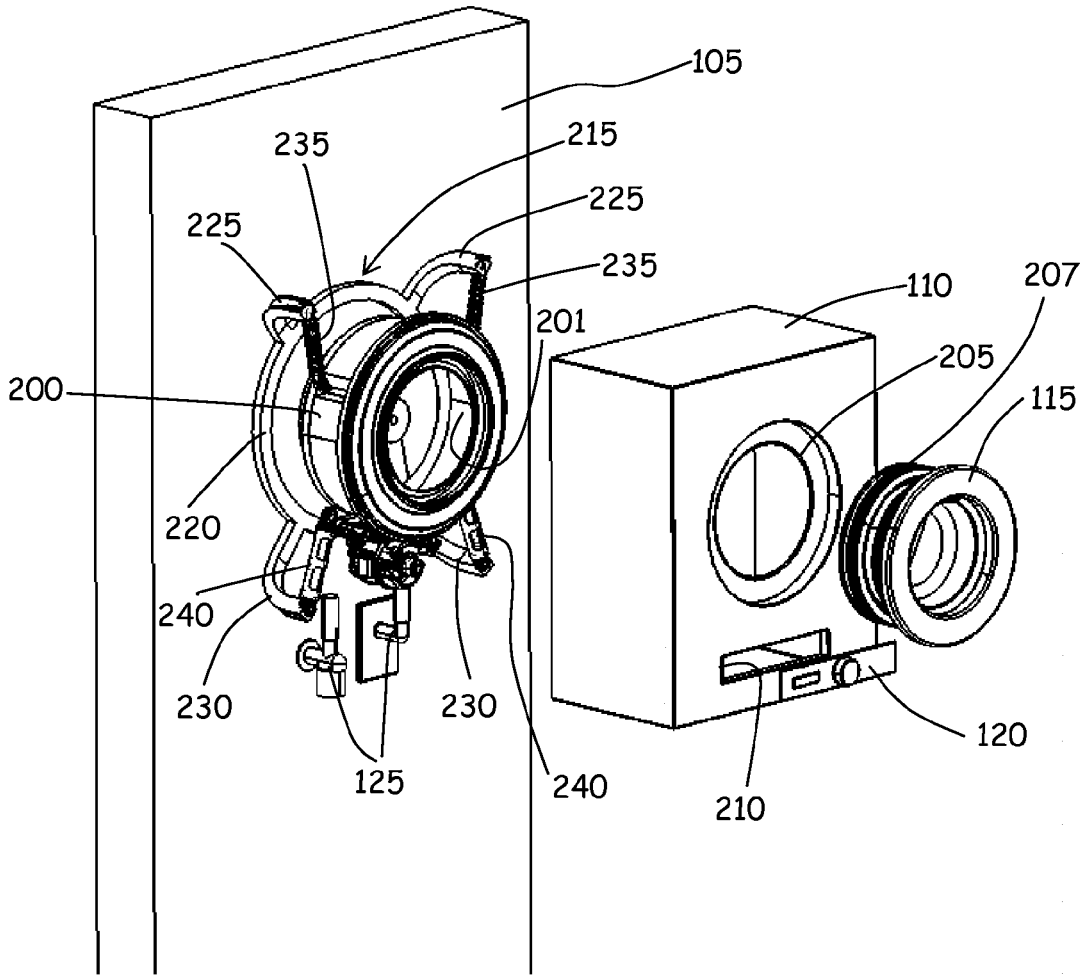
FIG. 2 shows a wall-mounted household appliance according to an embodiment of the present invention in partial exploded view.
Figure 3:
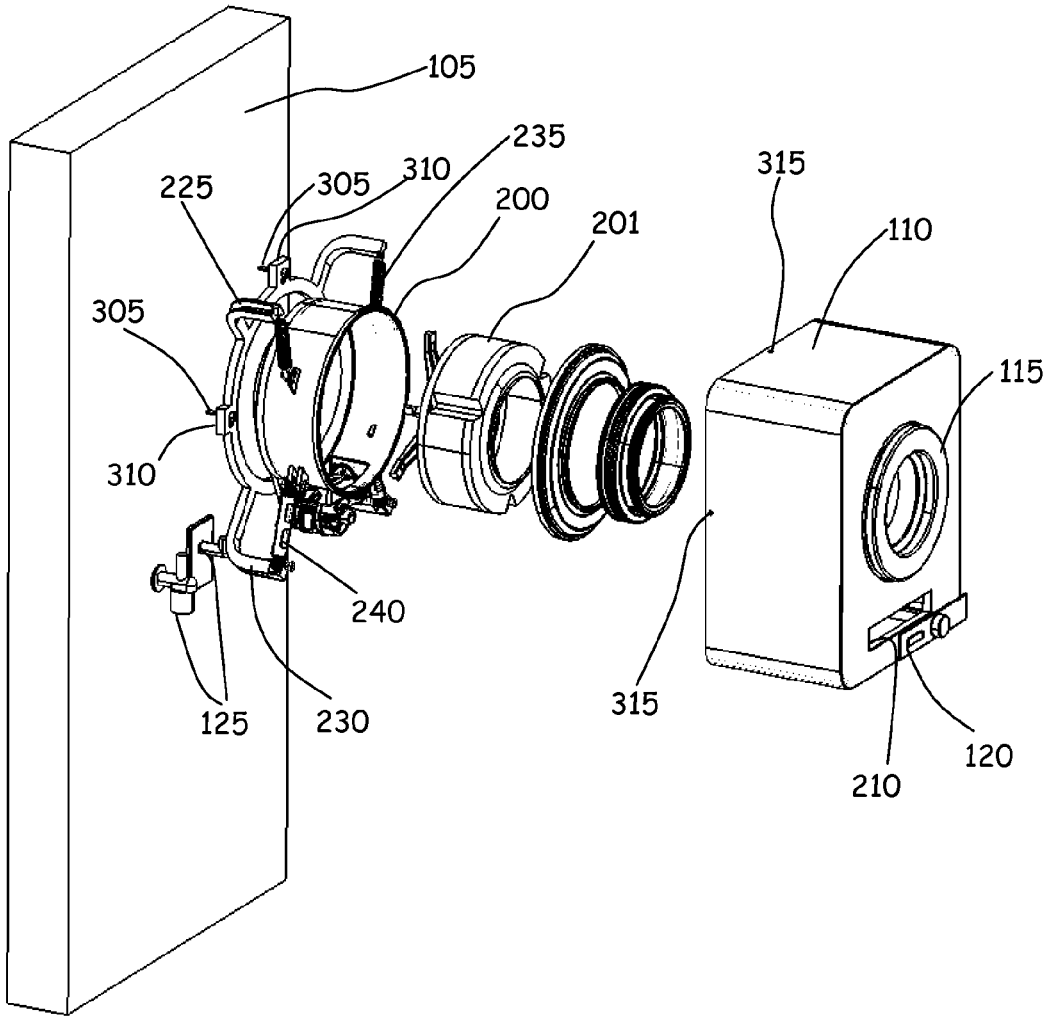
FIG. 3 shows the wall-mounted household appliance of FIG. 2 in exploded view.
Figure 4:
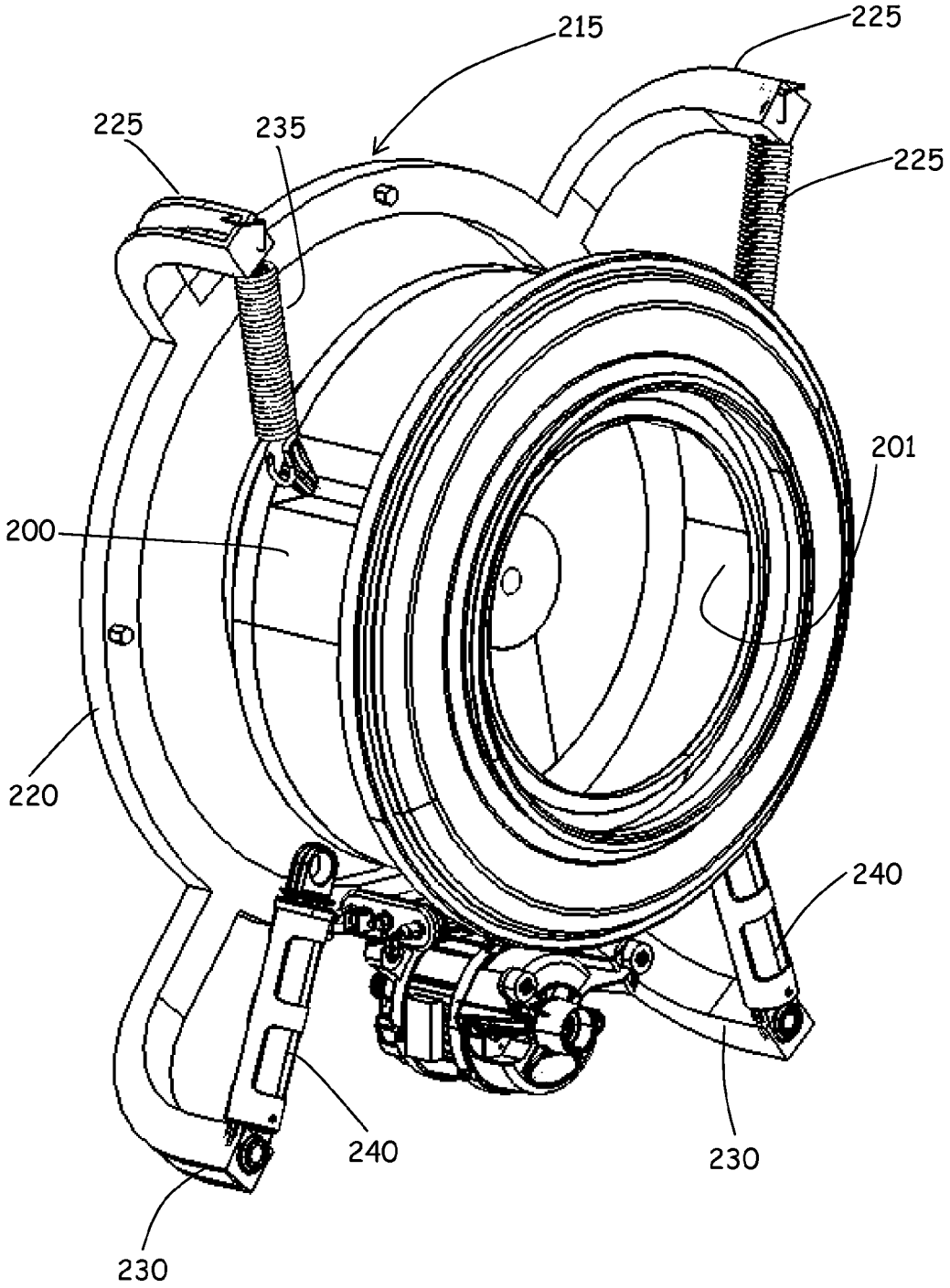
FIGS. 4 and 5 show in greater detail a wall-mounting arrangement of the wall-mounted household appliance of FIGS. 1, 2 and 3 according to an embodiment of the present invention.
Figure 5:
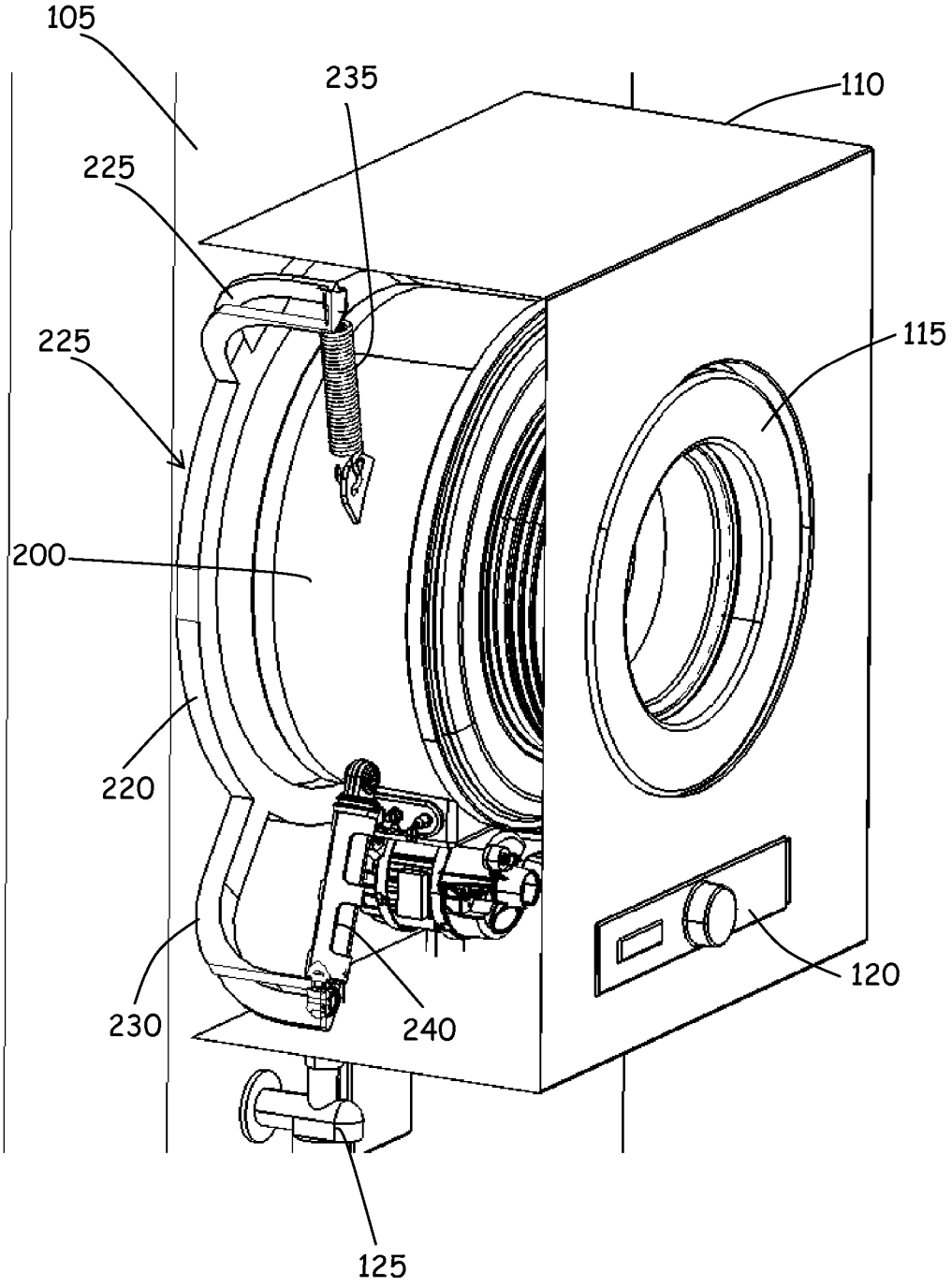

Referring to the drawings, in FIG. 1 there is shown a wall-mounted laundry washer 100 according to an embodiment of the present invention, mounted to a wall 105. The laundry washer 100 comprises an external casing 110, accommodating therein a washing assembly comprising a washing tub and, rotatably housed inside the tub, a rotatable drum. The casing 110 has a front opening, for allowing access to the drum and load/unload the items to be treated, and a door 115 is provided for closing the load/unload opening. Below the door 115, a control and indicator panel (user interface) 120 is provided. Also shown in the drawing are couplings 125, provided on the wall 105, to which a fresh water intake (cold or/and hot) and a discharge outlet of the laundry washer 100 are connected, respectively for the intake of fresh water and for the discharge of the washing liquid (in some embodiments, the water intake may also include a hot water intake, in addition to a cold water intake).

Making reference to FIGS. 2 to 5, an embodiment according to the present invention of the wall-mounted laundry washer 100 is shown; in these figures, the washing tub is denoted 200 and the rotatable drum is denoted 201; the front opening provided in the casing for allowing access to the drum and load/unload the items to be treated is denoted 205.

The casing 110, generally rectangular in shape, may be constituted by a plastic body, formed for example by injection moulding, open at the rear, with an opening 210, below the opening 205, for receiving the control and indicator panel 120.

The choice of the plastic material to be used for forming the casing 110 may depend on aesthetic requirements. In fact, thanks to the wall-mounting arrangement that will be described, the cabinet 110 has no structural function.

The dimensions of the casing 110 are such as to be able to accommodate, in addition to the washing assembly of desired size and capacity (e.g., 1.5-2 Kg of cotton load), all the necessary components of the laundry washer, for example, a heater for heating the washing liquid, a hydraulic circuit for the circulation of the washing liquid, a liquid discharge pump or valve. In case the appliance is a washer/dryer, additional or different components are accommodated within the casing 110, like a drying air circulation system, including a demoisturizing system for example comprising an air-cooled condenser, a water-cooled condenser, a condenser part of a heat pump system, a defluff filter and any other known component necessary for a dryer.

For the rotation of the drum 201, a direct-drive arrangement is preferably adopted, with an electric motor directly driving a drum hub; however nothing prevents from using other solutions, like an electric motor with a belt transmission.

The liquid discharge pump or valve may be mounted directly to the washing assembly.

A wall-mounting arrangement is designed to allow the direct mounting of the washing assembly to the wall 105. The wall-mounting arrangement comprises a wall-mounting frame 215 with a portion 220, for example ring-shaped, adapted and intended to be fixed to the wall 105, e.g. by means of screws or screw anchors (visible in FIG. 3, where the screws, denoted 305, are inserted into through-holes formed in appendages 310 projecting from the ring-shaped portion 220, for example distributed along the perimeter thereof), and arms 225, 230 projecting from the ring-shaped frame portion 220. The arms 225, 230 may include a pair of upper arms 225, projecting from the upper part of the ring-shaped frame portion 220 and spaced apart from each other, and a pair of lower arms 230, projecting from the lower part of the ring-shaped frame portion 220 and also spaced apart from each other. The two upper arms 225 may for example be vertically aligned to the two lower arms 230. The wall-mounting frame 215, i.e. the ring-shaped portion 220 and the arms 225, 230, is preferably in a single-piece construction, and may be made of metal or hard plastic material.

The washing assembly is elastically coupled to the wall-mounting frame 215, by means of springs and dampers. For example, a pair of springs 235 are at one end connected, e.g. hooked to the upper arms 225, and, at the other end, the springs 235 are connected, e.g. hooked to an upper part of a cylindrical lateral wall of the washing tub 200, at two angularly-spaced positions. A pair of dampers 240 are at one end connected, e.g. through nut-screws, to the lower arms 230, and, at the other end, the dampers 230 are connected, still by nut-screws, to a lower part of the cylindrical lateral wall of the washing tub 200.

The door 115 may be hinged to casing 110. A bellow 207 is provided frontally to the washing assembly for ensuring water tightening and at the same time allowing relative movement of the washing assembly with respect to the casing (and thus the door). Alternatively, the door 115 may be hinged to the washing assembly (in which case the bellow may be dispensed for).

The laundry washer 100 can be mounted to the wall 105 by preliminary affixing thereto the wall-mounting frame 215 alone; screws or screw anchors or similar means can be used for this purpose. Then, the washing assembly is hung up to the wall-mounting frame, by connecting the springs 235 and the dampers 240 to the arms 225 and 230 and to the washing tub 200. The casing 110 is then mounted. The casing 110 may be fixed to the wall-mounting frame 215, for example using screws that are inserted into through-holes provided in suitable positions in the side walls of the casing 110 itself, and then the screws are tightened; as an alternative to the use of screws, clips may be used.

The drum and the washing tub forms a unique washing assembly, because the drum rotation shaft is rotatably supported by ball bearings that are housed inside a sleeve over which the washing tub is moulded, so that, in operation, the washing assembly moves as a whole. The movement of the washing assembly generated by the rotation of the drum is partially dampened by the springs 235 and dampers 240, and transferred to the casing 110 as vibrations. Thanks to the fact that the washing assembly is elastically coupled to the frame, relatively high drum rotational speeds can be sustained without problems.

In FIGS. 6 to 16, some alternative solutions according to embodiments of the present invention for affixing the laundry washer 100 to the wall are shown, which will be now discussed.

Figure 6:
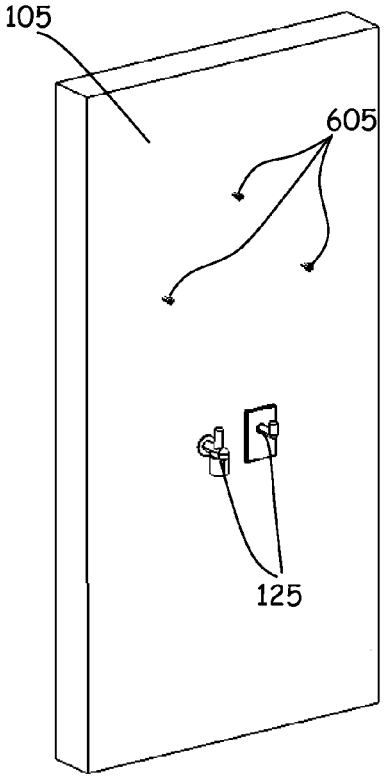
FIGS. 6 to 19 show alternative solutions for affixing the household appliance to the wall, according to embodiments of the present invention.
Figure 7:
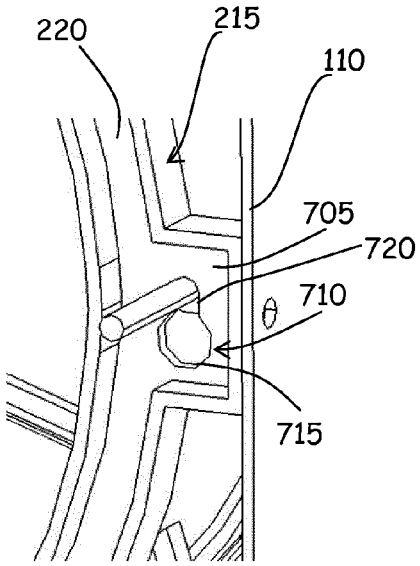

Referring to FIGS. 6 and 7, screws or screw anchors 605, for example three in number, are firstly fixed to the wall 105, properly spaced apart from one another, and left protruding from the wall 105 surface. Then, the wall-mounting frame 215 is hung up to the wall 105 by hanging it up to the projecting portions of the screws 605; the wall-mounting frame 215 is provided, for example in appendages 705 projecting from the ring-shaped portion 220, of slots 710 having a wider portion 715 and a narrower portion 720; the wider portions 715 are wide enough to enable passage of the heads of the screws 605, whereas the narrower portions 720 are narrower than the screws heads but sufficiently wide to enable sliding therein of the screws stems. The remaining parts of the laundry washer 100 are then mounted to the frame 215 as described in the foregoing.

Figure 8:
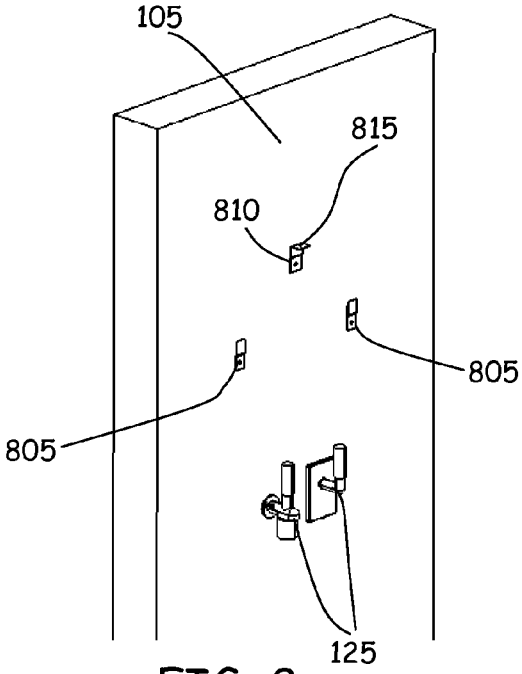
Figure 9:
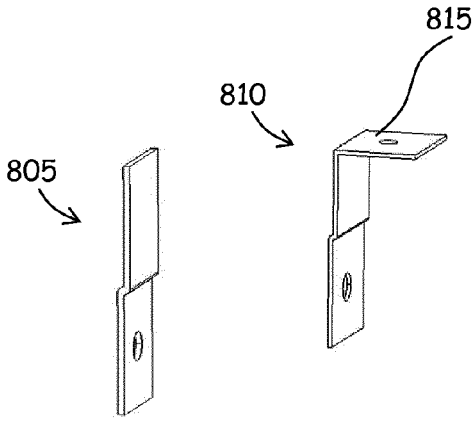

The solution depicted in FIGS. 8 and 9 makes use of wall-mount brackets 805, 810 for affixing the wall-mounting frame 215 to the wall 105. The brackets 805, 810 are firstly attached to the wall 105, for example by means of screws or screw anchors. The brackets 805 and 810 may be slightly different in shape: for example, the upper bracket 810 may have, compared with the lower brackets 805, an upper bent portion 815 that is adapted to form an abutment for the wall-mounting frame 215.

Figure 10:
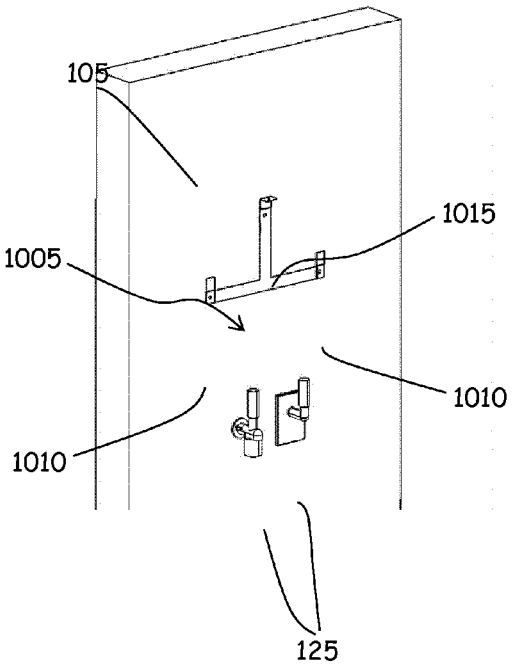
Figure 11:
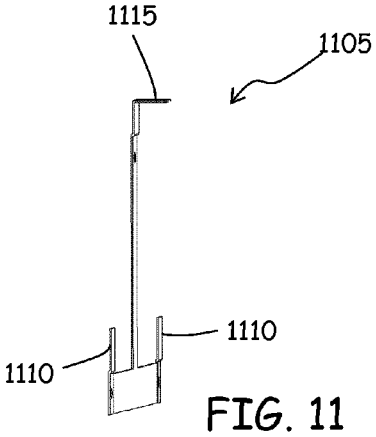

The solutions depicted in FIGS. 10 and 11 may be regarded as variations of that of FIGS. 8 and 9: in this case, the three brackets 805, 810 are replaced by a single wall-mount bracket 1005 or 1105, made in a single-piece construction of, e.g., steel, properly cut and bent to form appendages 1010, 1015, respectively 1110, 1115, shaped essentially as the brackets 805, 810, for hanging the wall-mounting frame 215 up.

Figure 12:
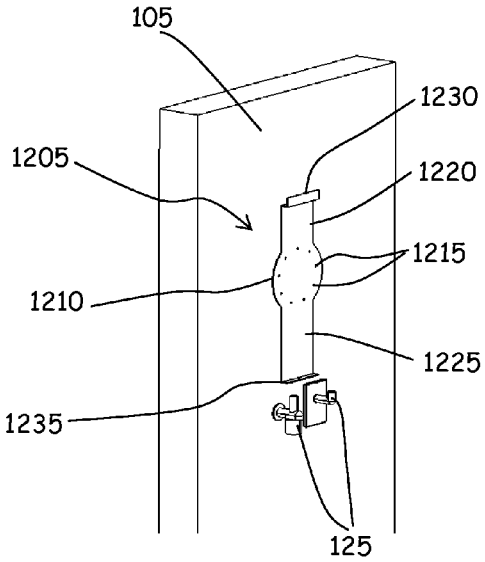
Figure 13:
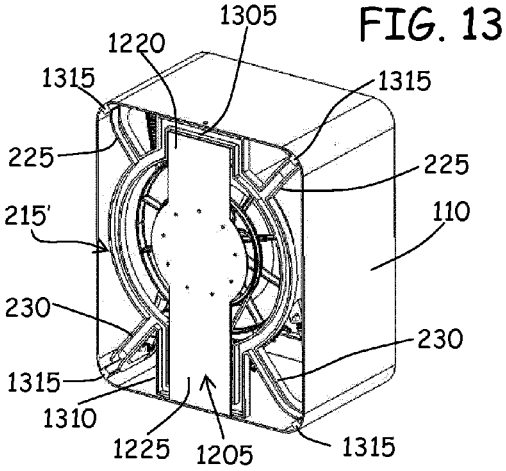
Figure 14:
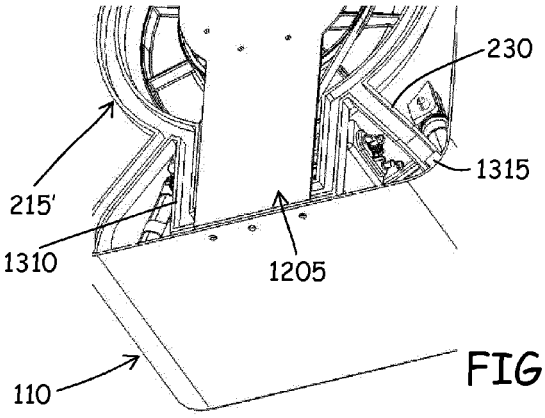

Also in the solution of FIGS. 12-14 use is made of a single, one-piece wall-mount bracket 1205, having a central portion 1210, e.g. circular in shape, provided with through holes 1215 for affixing the bracket 1205 to the wall 105, by means of screws or screw anchors. Upper and lower appendages 1220 and 1225 depart from the bracket central portion 1210, which appendages 1220 and 1225 at their ends are bent to define, the former a "reverse L"-shaped hook 1230, and, the latter, a shoulder 1235. A wall-mounting frame 215', as shown in FIGS. 13 and 14, has a slightly different shape compared to the wall-mounting frame 215 described in the foregoing: a ring-shaped portion 220' of the frame 215', corresponding to the ring-shaped portion 220 previously described, has an upper and a lower extensions 1305 and 1310 so as to be configured to accommodate the upper and lower appendages 1220 and 1225 of the bracket 1205. The wall-mounting frame 215' can be hung up to the hook 1230, whereas the shoulder 1235 remains interposed between the frame 215' and the bottom wall of the casing 110; the shoulder 1235 supports the frame 215' and is arranged so as to enable the bottom wall of the casing 110 to be fixed thereto. Preferably, the arms 225 and 230 of the frame 215' are grooved on their outer side, so to be able to slidably receive guiding fins 1315 provided on the inside of the casing 110 at the corners thereof: this facilitates the correct mounting of the casing onto the frame 215', by sliding the casing onto the frame 215'.

Figure 15:
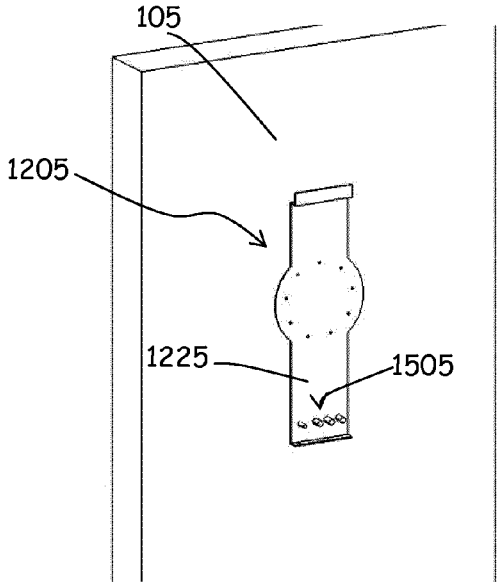
Figure 16:
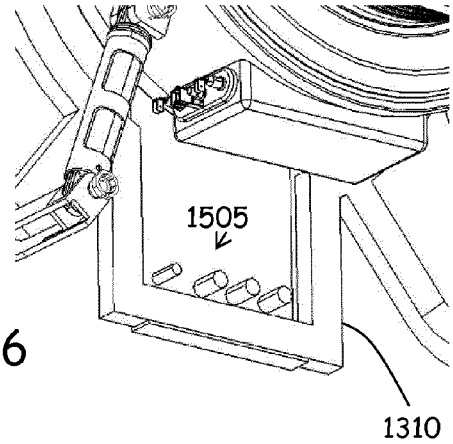
Figure 17:
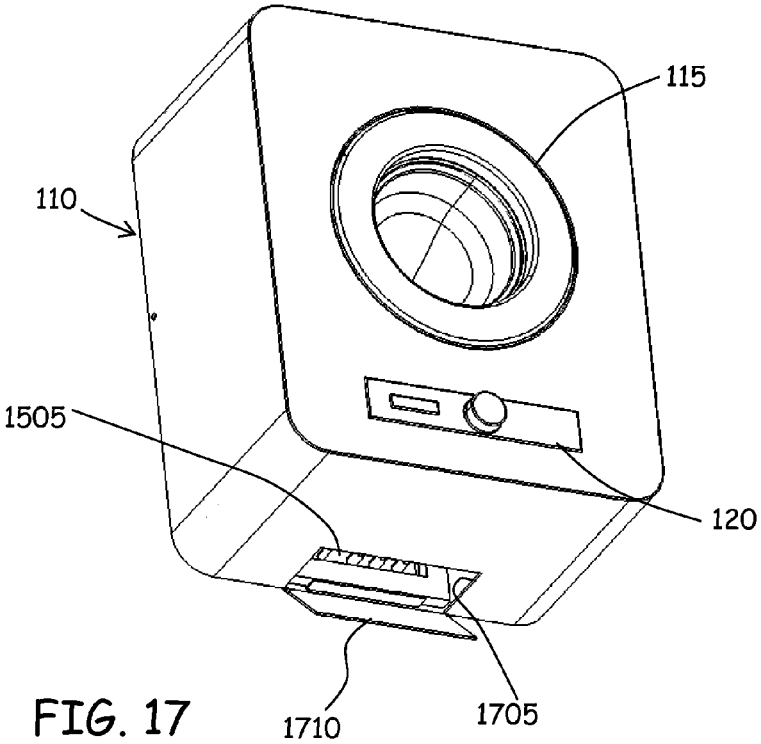

The solution of FIGS. 12-14 can be slightly modified as depicted in FIGS. 15-17, in such a way that the casing 110 covers also the hydraulic/electric couplings (denoted as a whole 1505). Both the lower appendage 1225 of the bracket 1205 and the lower extension 1310 of the wall-mounting frame 215' are prolonged so that, when installed, they extend downwards below the coupling 1505. The casing 110 is advantageously provided with an opening 1705 closable by a door 1710 on the bottom wall thereof, so as to enable access to the couplings 1505.

Figure 18:
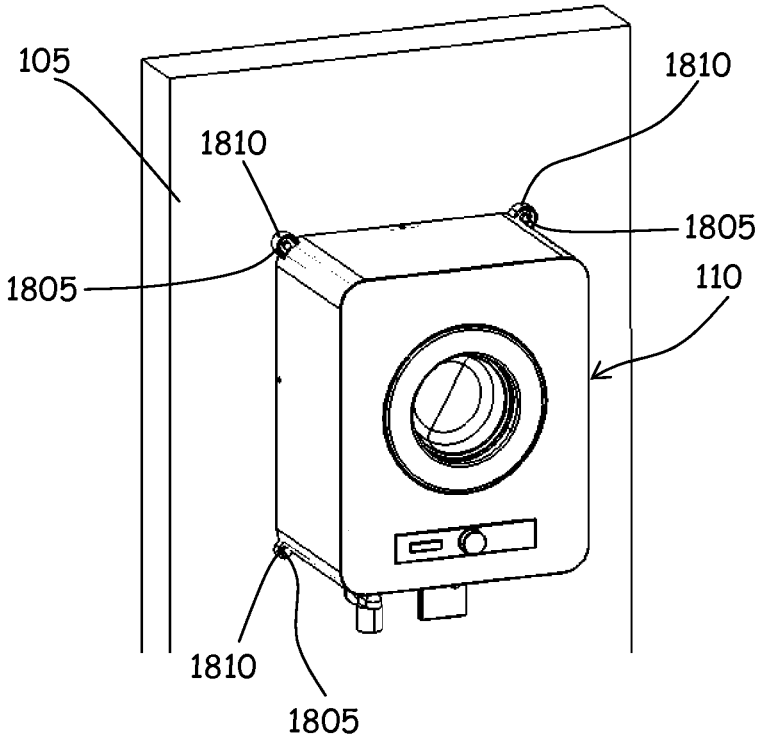

FIG. 18 shows still another solution for affixing the laundry washer 100 to the wall, which can be also combined with the solutions previously described. In this case, the casing 110 is itself affixed to the wall 105, by means of screws or screw anchors 1805, inserted in through holes provided in ears 1810 projecting from the casing 110 at the corners thereof.

Figure 19:
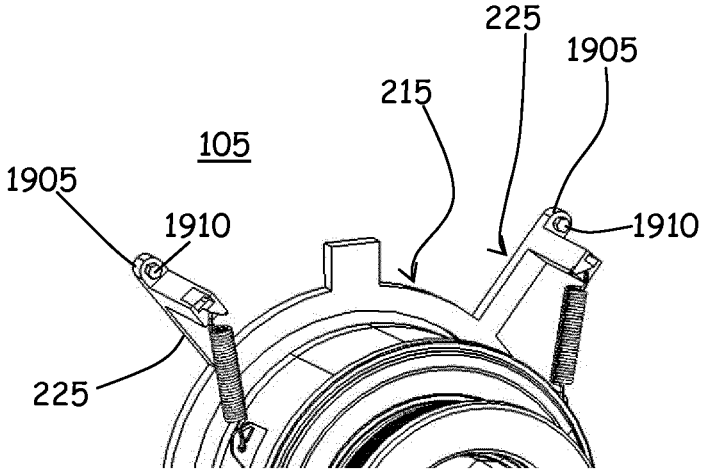

Finally, FIG. 19 shows an alternative solution for affixing the wall-mounting frame 215 to the wall 105. In this case, the upper arms 225 (and, preferably, also the lower arms 230) of the frame 215 are provided with ears 1905 having through holes for the insertion of screws or screw anchors 1910 for affixing the frame directly to the wall 105.

Figure 20:
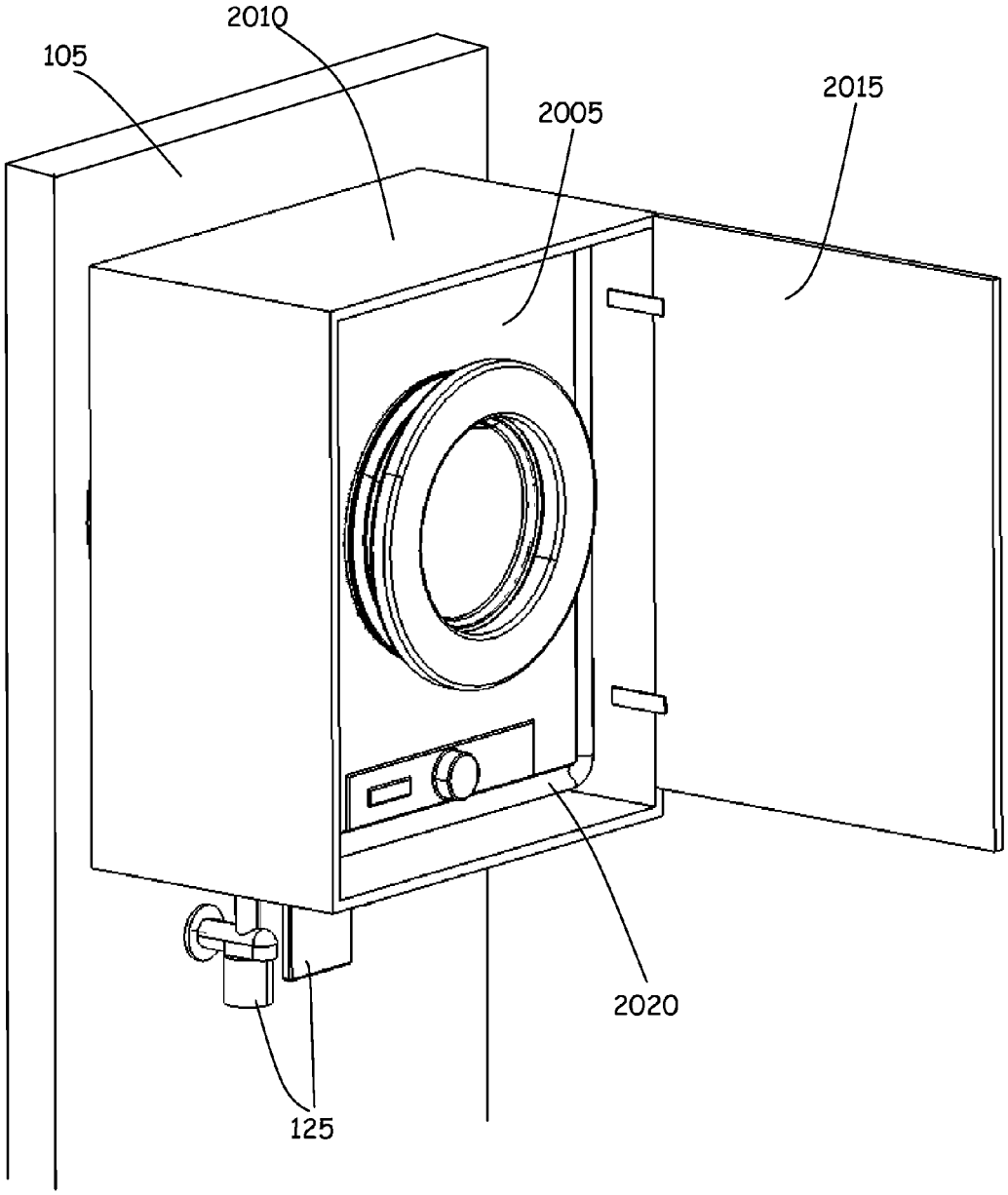
FIGS. 20 and 21 show a wall-mounted household appliance according to another embodiment of the present invention.
Figure 21:
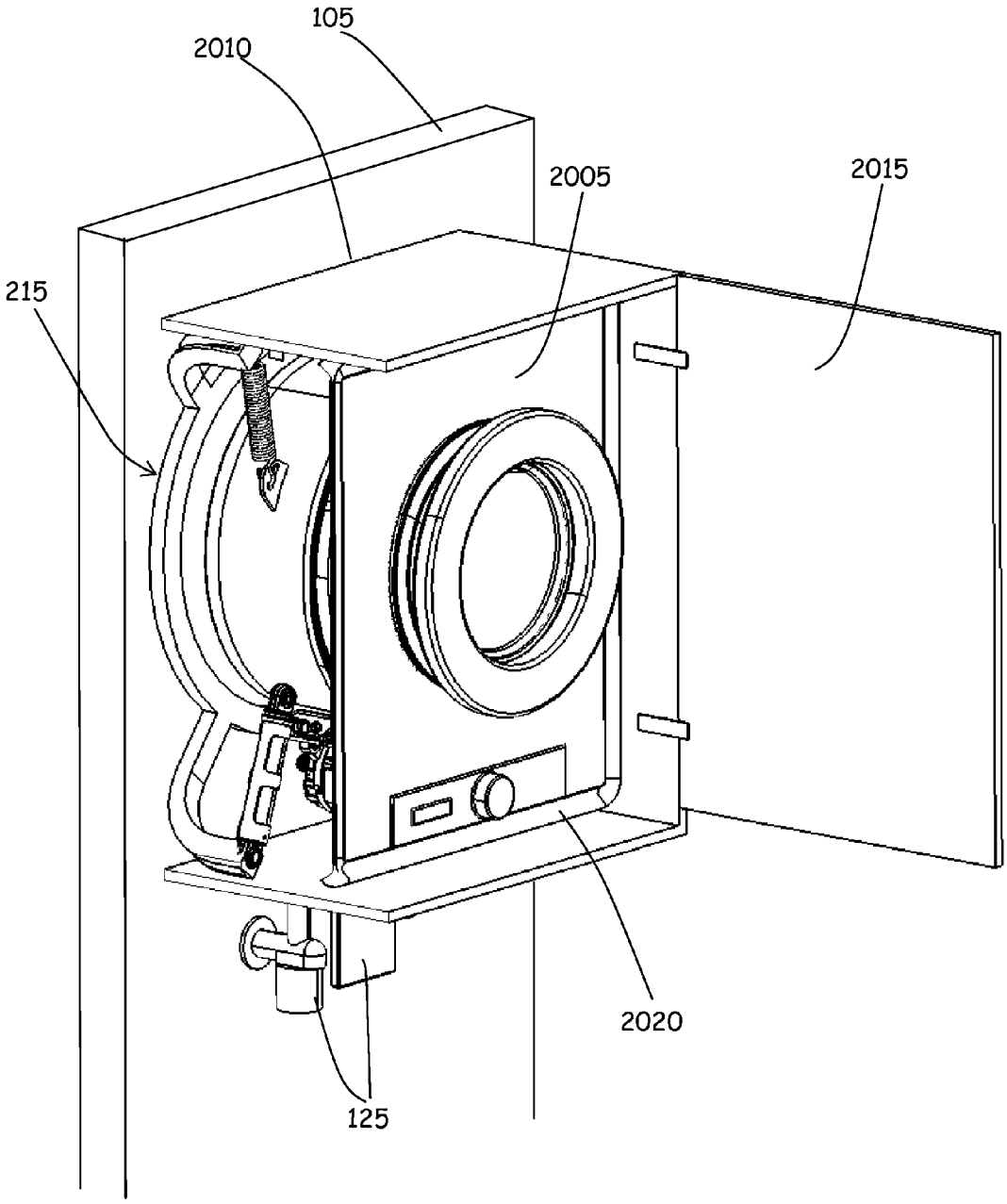

In the embodiment of FIGS. 20 and 21, suitable for a "built-in" appliance, the casing 110 is not part of the appliance, being replaced by a front panel 2005, similar to the front panel of the casing 110. The appliance, comprised of the washing assembly, and the front panel 2005 with the door 115, is mounted to the wall 105 as in the previously described embodiments, and is enclosed in an external cabinet 2010, for example part of the furniture, having a door 2015, which external cabinet 2010 is hung up to the wall 105. In this embodiment, the bellow 207 may be absent, and thus the front panel 2005 moves together with the washing assembly, in which case along the rim of the front panel 2005 a rubber gasket 2020 is provided, to absorb the vibrations of the front panel.

Figure 22:
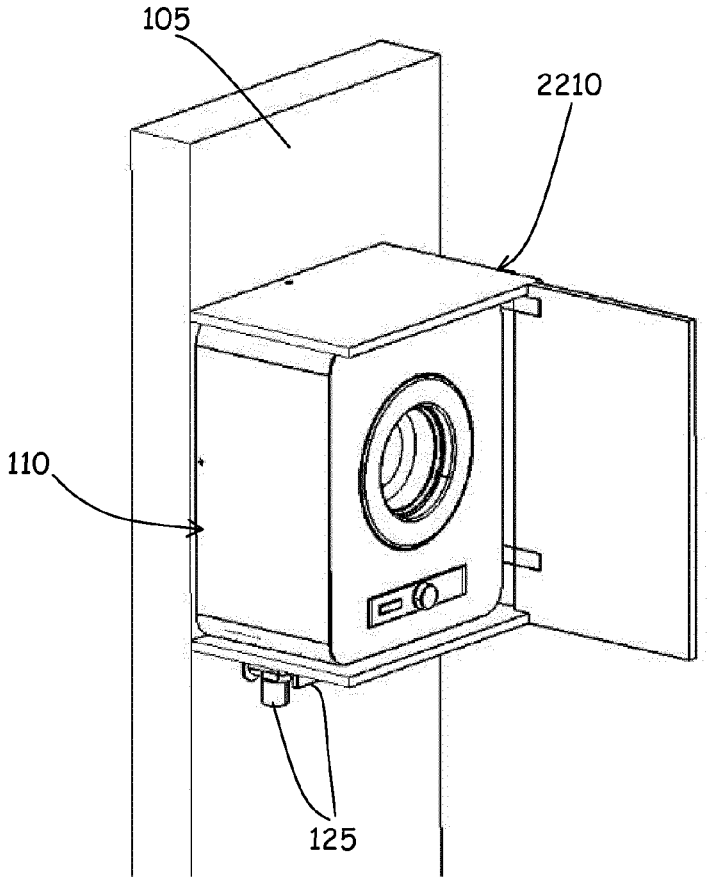
FIGS. 22 and 23 show a wall-mounted household appliance according to still another embodiment of the present invention.
Figure 23:
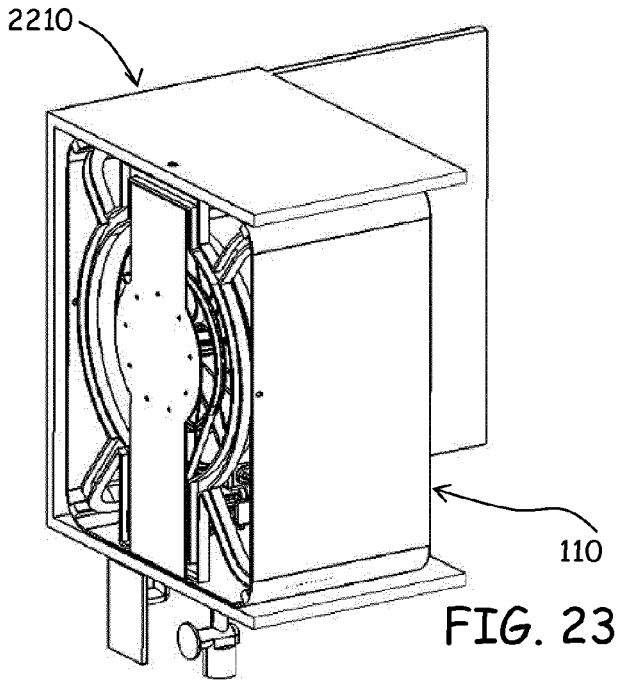

In any case, nothing prevents from enclosing the laundry washer with its casing 110 inside an external cabinet 2210, as depicted in FIGS. 22 and 23; the external cabinet 2210 can be totally similar to the cabinet 2010 of FIGS. 20 and 21, being possibly a little wider for accommodating also the casing 110.

Several embodiments of the present invention have been here described, and it should be understood that many of the described embodiments are not merely alternative to one another but are instead adapted to be combined. However it is clear to those skilled in the art that several changes to the described embodiments, as well as other embodiments are possible, without departing from the scope of the appended claims.

The invention claimed is:

1. A household appliance comprising a washing assembly with a washing tub rotatably housing a rotatable drum, wherein the household appliance is configured to be mounted to a wall, wherein the washing tub has a rear side adapted to generally face the wall when the household appliance is mounted to the wall, a front side including an access opening into the rotatable drum, and a lateral wall extending from the rear side to the front side and wherein the household appliance further comprises:

a wall-mounting frame configured to be fixed to the wall, and at least one elastic coupling element elastically coupling the washing tub to the wall-mounting frame, the at least one elastic coupling element being connected at a respective one end thereof to an external side of the lateral wall of the washing tub.

2. The household appliance of claim 1, wherein the wall-mounting frame comprises a central frame portion and a plurality of frame arms projecting from the frame portion, the at least one elastic coupling element being connected at a respective another end thereof to a respective one of the projecting frame arms.

3. The household appliance of claim 2, wherein the at least one elastic coupling element comprises at least two dampers and the plurality of frame arms comprises two lower arms, each connected to the another end of a respective one of the two dampers.

4. The household appliance of claim 3, wherein the at least one elastic coupling element comprises at least one spring and the plurality of frame arms comprise at least one upper arm connected to the another end of the at least one spring.

5. The household appliance of claim 3, wherein the at least one elastic coupling element comprises two springs and the plurality of frame arms comprises two upper arms, each upper arm connected to the another end of a respective one of the two springs.

6. The household appliance of claim 2, wherein the wall-mounting frame is configured to be affixed to the wall by means of screws and/or anchor screws and/or one or more brackets affixed to the wall.

7. The household appliance of claim 6, wherein the wall-mounting frame is configured to be affixed to the wall by at least one of the central frame portion and the plurality of frame arms.

8. The household appliance according to claim 1, comprising a casing accommodating the washing assembly.

9. The household appliance according to claim 8, wherein the casing is configured to be affixed to the wall-mounting frame.

10. The household appliance according to claim 8, wherein the casing is elastically coupled to the washing assembly by means of a bellow.

11. The household appliance of claim 1, further comprising a front panel coupled to the washing assembly.

12. The household appliance of claim 1, wherein the household appliance is one among a laundry washer and a laundry washer/dryer.

13. The household appliance according to claim 9, wherein the casing is configured to be affixed to the wall-mounting frame by means of screws.

14. The household appliance according to claim 2, wherein the central frame portion is disposed between the washing tub and the wall, and wherein the plurality of frame arms extend in a direction toward the front side of the washing tub.

15. The household appliance according to claim 2, wherein the central frame portion is integrally formed in one piece with the plurality of frame arms.

16. The household appliance according to claim 1, wherein the at least one elastic coupling element extends radially outward from the external side of the lateral wall of the washing tub.

* * * * *